United States Patent [19]

Gondek

[11] 4,179,889

[45] Dec. 25, 1979

[54] CONTROL CIRCUIT FOR HYDRAULIC CYLINDER AND SHAFT ASSEMBLY

[76] Inventor: John T. Gondek, 1641 Innsbruk Cir. W., Minneapolis, Minn. 55421

[21] Appl. No.: 880,292

[22] Filed: Feb. 22, 1978

[51] Int. Cl.[2] ..... F15B 15/18

[52] U.S. Cl. ..... 60/477; 91/447; 91/454; 91/461

[58] Field of Search ..... 60/477, 481, 431, ; 91/447, 454, 461, 468

[56] References Cited

U.S. PATENT DOCUMENTS

| | | | |
|---|---|---|---|
| 2,900,960 | 8/1959 | Gratzmuller | 91/454 X |
| 3,255,587 | 6/1966 | London | 60/481 |
| 3,800,537 | 8/1974 | Denis | 60/481 |

*Primary Examiner*—Edgar W. Geoghegan
*Attorney, Agent, or Firm*—Rudolph L. Lowell; G. Brian Pingel

[57] ABSTRACT

A control circuit for a hydraulic cylinder and shaft assembly to regulate movement of the shaft relative to one end of the cylinder. The circuit has a fluid pressure supply and associated reservoir and a metering valve with interconnected normally closed passage means connected at one end to the one cylinder end and at an opposite end to the reservoir. The fluid pressure supply, in a first condition, supplies fluid under pressure to the one cylinder end, and, in a second condition supplies piloting fluid under pressure for actuating the metering valve to regulate the fluid flow from the one cylinder end to the reservoir through the normally closed passage means. In a first preferred embodiment, the control circuit fluid pressure supply comprises a three position control valve and a variable speed motor for driving a unidirectional, fixed displacement fluid pump, whereas in a second preferred embodiment the fluid pressure supply is comprised of a variable speed bi-directional motor which drives a fixed displacement bi-directional pump.

13 Claims, 8 Drawing Figures

CONTROL CIRCUIT FOR HYDRAULIC CYLINDER AND SHAFT ASSEMBLY

SUMMARY OF THE INVENTION

The present invention provides a hydraulic cylinder and shaft assembly control circuit for regulating the movement of the shaft. Included in the control circuit is a fluid pressure supply and associated reservoir, and a metering valve means having a normally closed passage means. The fluid pressure supply means, in a first condition, supplies fluid to the cylinder through a check valve and, in a second condition, supplies piloting fluid to the valve means to actuate the valve means and thereby open the normally closed passage means to regulate fluid flow from the cylinder to the reservoir.

In the preferred embodiments of the control circuit, the metering valve means includes an open passage means through which the fluid pressure supply means supplies fluid to the cylinder to move the shaft therefor in one direction and a normally closed passage means formed of two passageways interconnected by a valve chamber. One of the interconnected passageways is connected with the cylinder whereas the other passageway is connectable with the reservoir. The valve member located in the valve chamber normally blocks fluid flow through the interconnected passageways and includes a valve spool that is movable, upon actuation of the valve member, to open the normally closed passage means. The valve spool has a plurality of peripheral grooves arranged so that a number of the grooves extend between and connect the passageways of the normally closed passage means upon actuation of the valve means. The greater the pressure of the piloting fluid the greater is the displacement of the spool against a high rate spring to increase the cross sectional area of the spool grooves connecting the passageways so that a precision regulation of flow through the normally closed passage means is obtained.

DESCRIPTION OF THE PREFERRED EMBODIMENTS

Figure 1:
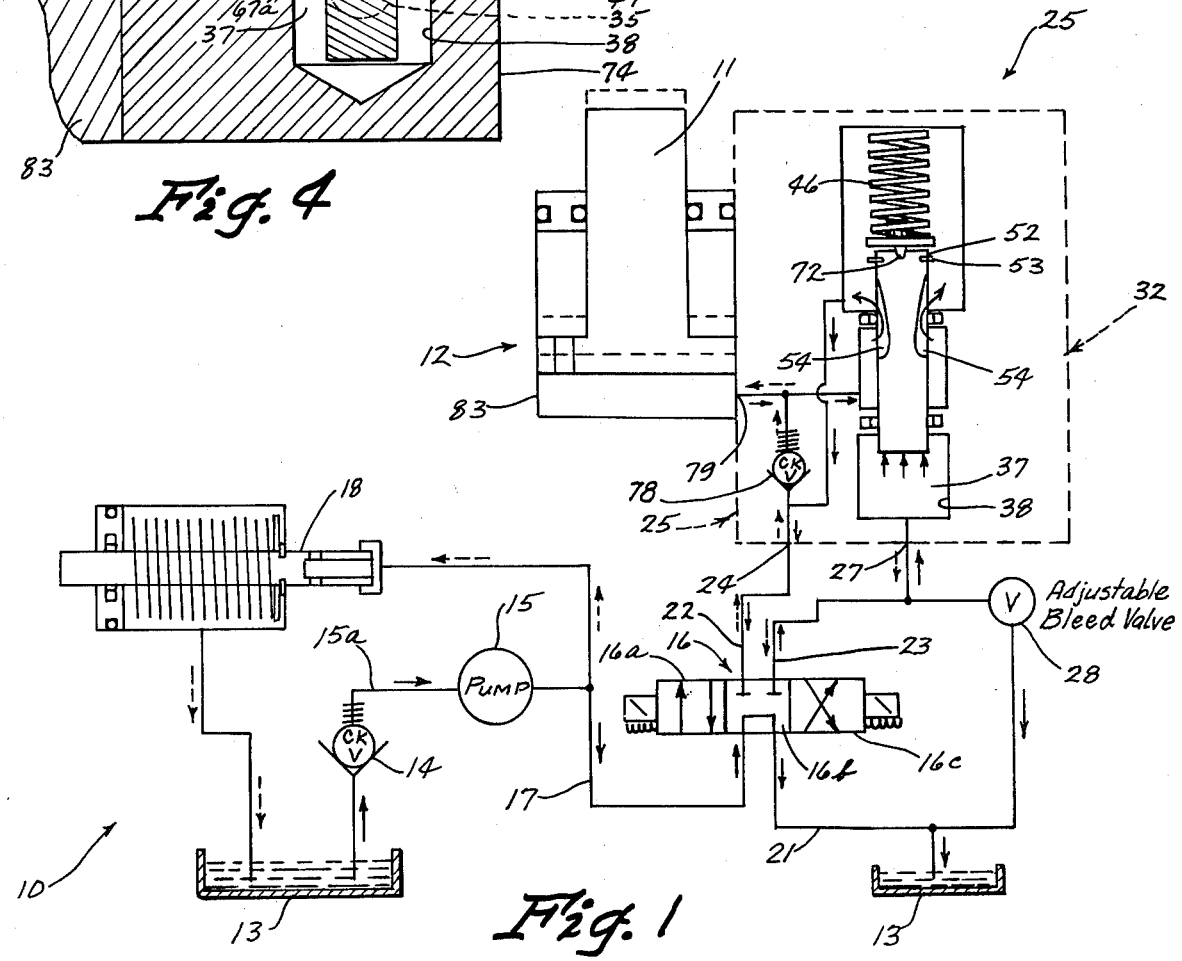
FIG. 1 is a schematic representation of a first preferred embodiment of the control circuit for a hydraulic cylinder and shaft assembly.

A first preferred embodiment of the control circuit of the present invention indicated generally at 10 in FIG. 1 is adapted to control the movement of a shaft 11 forming part of a single acting hydraulic cylinder and shaft assembly 12.

The circuit 10 includes a unidirectional fixed displacement fluid pump 15 driven by a variable speed motor (not shown) and having an inlet connected to a fluid reservoir 13 by a line 15*a*. A check valve 14 in the line 15*a* prevents a back flow from the pump inlet to the reservoir. Fluid drawn from the reservoir 13 by the pump 15 is supplied under pressure to a control valve 16 through a fluid line 17. A relief valve 18 connected between the line 17 and the reservoir limits the maximum pressure of the fluid supplied by the pump 15 to the cylinder assembly 12.

The control valve 16 is a solenoid controlled, spring centered, four-way valve that serves as a fluid flow directional device and has three valve positions; an "up" position 16*a*, a neutral position 16*b* and a "down" position 16*c*. In the neutral position the line 17 is connected to a reservoir return line 21. In the actuated "up" position 16*a*, lines 17 and 21 are connected to fluid lines 22 and 23, respectively, and in the actuated "down" position 16*c*, the lines 17 and 21 are connected to the lines 23 and 22, respectively.

The fluid line 22 connects the control valve 16 to a first port 24 of a valve assembly 25 that is preferably mounted on the cylinder and shaft assembly 12. The fluid line 23 connects the control valve 16 to a second port 27 of the valve assembly 25. An adjustable bleed valve 28 bridges the line 23 and the fluid reservoir 13 for a purpose to be described below.

Figure 2:
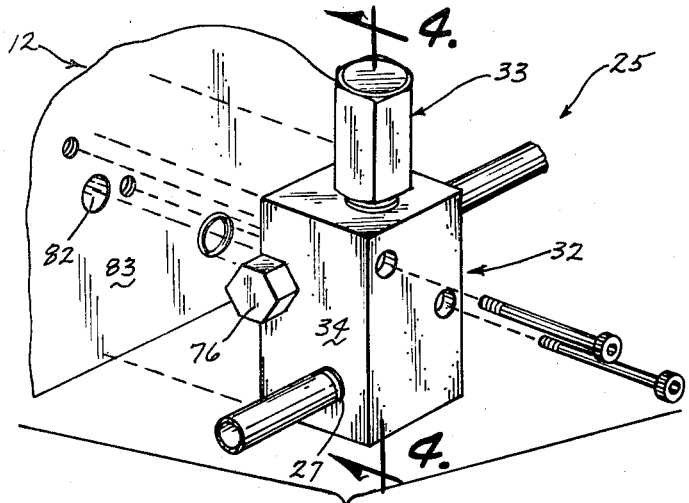
FIG. 2 is a perspective view of a metering valve which forms part of the control circuit of FIG. 1, illustrated with a fragmentary portion of the hydraulic cylinder assembly on which the metering valve is mounted.
Figure 3:
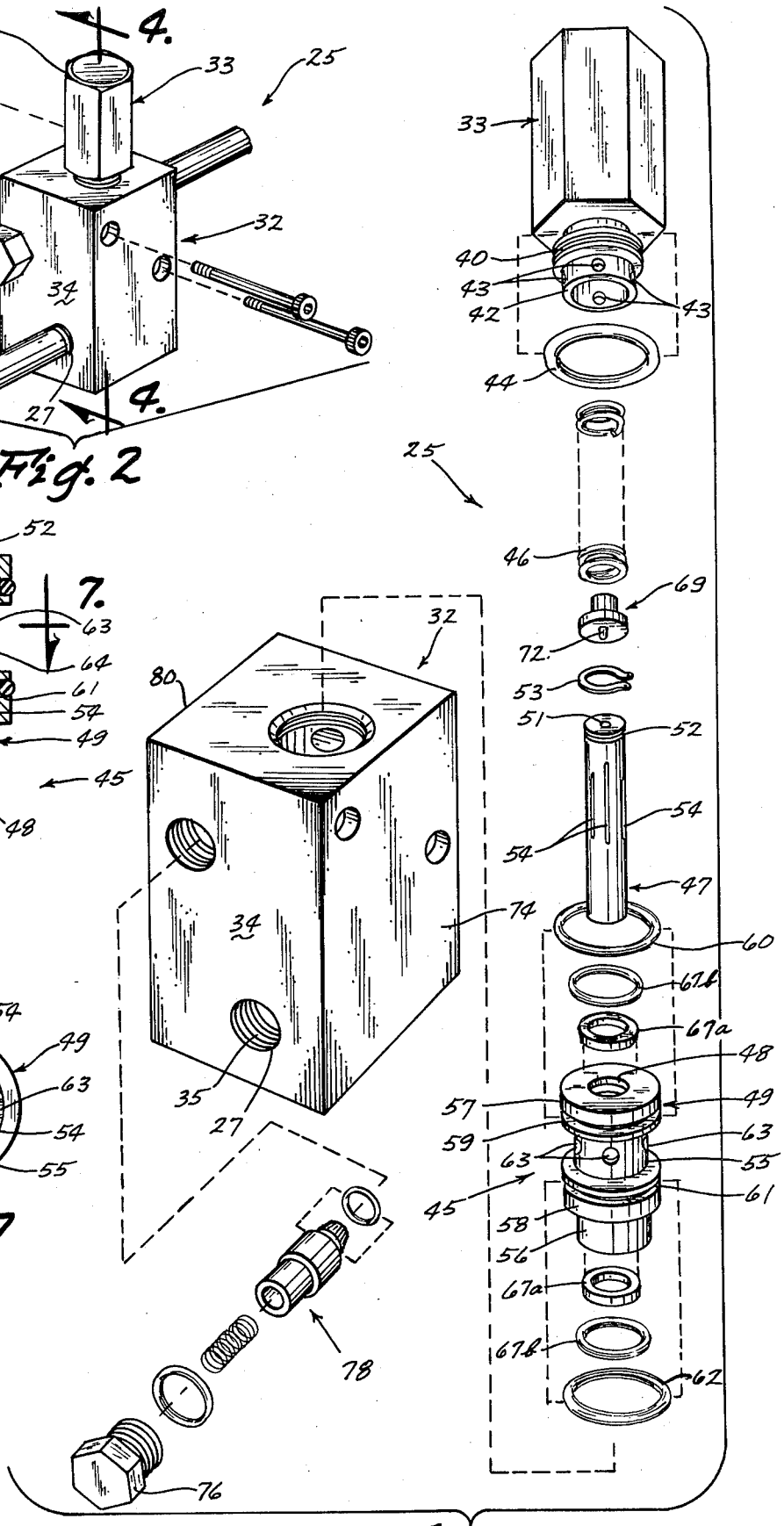
FIG. 3 is an exploded perspective view of the metering valve of FIG. 2.

As shown in FIGS. 2 and 3, the valve assembly 25 has a rectangular box-shaped body portion 32 and an elongated hexagonally-shaped head portion 33 that together form a housing for the working parts of the assembly 25. The port 27 is formed in the lower portion of a side wall 34 of the body portion 32 and opens to a passageway 35 (FIGS. 4 and 5) that connects with the bottom portion of a longitudinally extended interior chamber means 37 that is generally cylindrically shaped.

The chamber means 37 (FIG. 4) is formed of axially aligned cavities 38 and 39 formed in the body portion 32 and head portion 33, respectively. The body portion 32 and head portion 33 are secured together by means of an externally threaded neck 40 that protrudes from the bottom of the head portion 33 for threaded engagement within an upper threaded portion of the cavity 38. A terminal end portion 42 of the neck 40, of a reduced diameter, has a plurality of circumferentially spaced apertures 43 that open into the cavity 38. An O-ring 44 disposed about the neck 40 prevents leakage between the connection of the body and head portions 32 and 33, respectively. A valve member 45 is housed in the cavity 38 of the body portion 32 and a high rate coil spring 46 housed in the cavity 39 of the head portion 33 yieldably urges the valve member 45 in one direction for a purpose to appear later.

Figure 4:
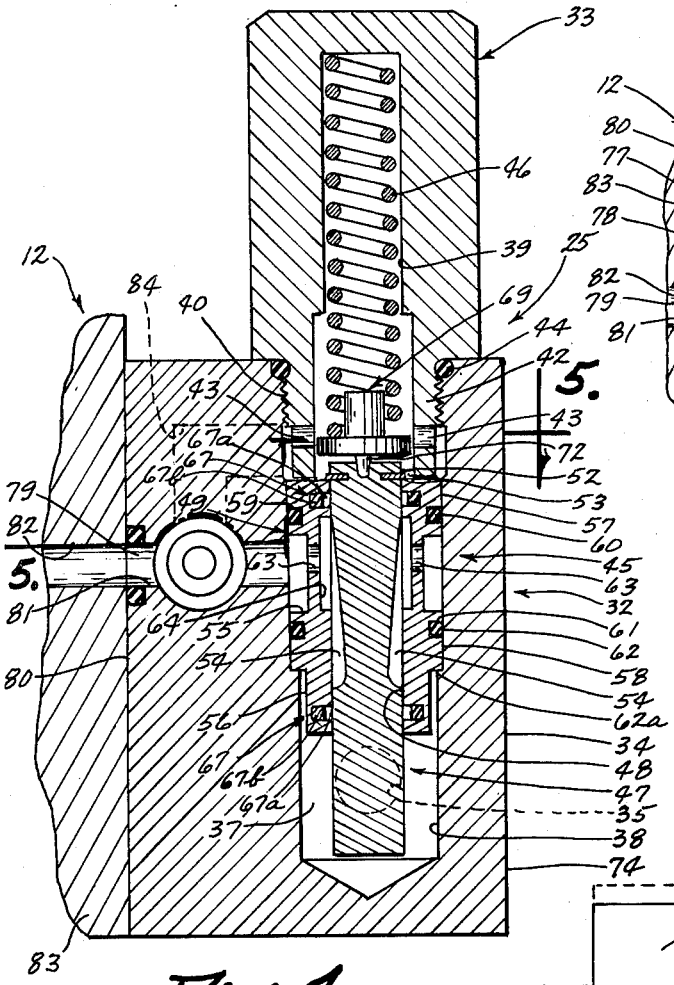
FIG. 4 is a longitudinal cross sectional view of the metering valve taken along the line 4—4 in FIG. 2.
Figure 5:
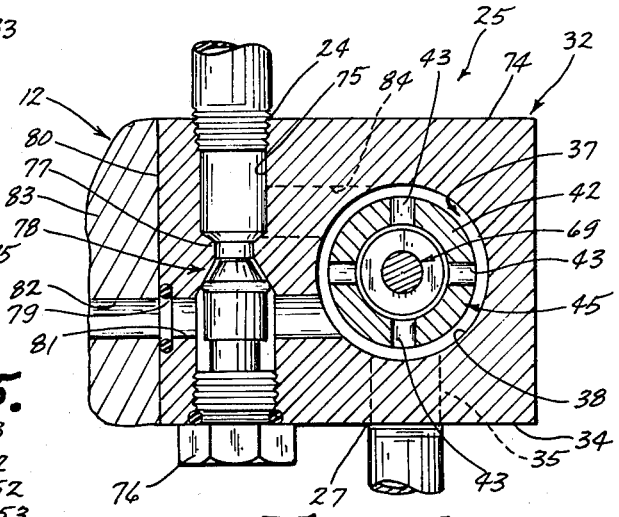
FIG. 5 is a transverse cross sectional view taken along the line 5—5 of FIG. 4.
Figure 6:
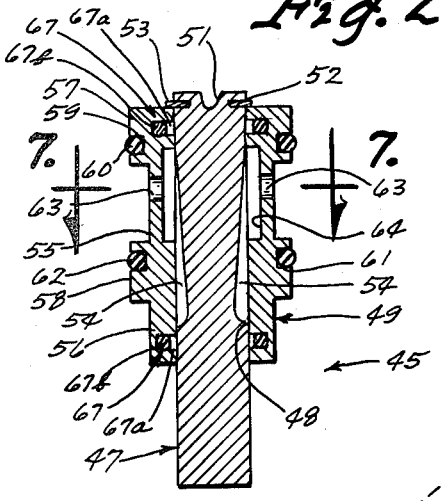
FIG. 6 shows a valve member of the metering valve of FIG. 2 illustrated similarly to its showing in FIG. 4.
Figure 7:
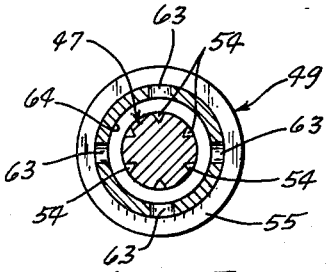
FIG. 7 is a transverse cross sectional view taken along the line 7—7 of FIG. 6.

Referring now to FIGS. 4 and 6, the valve member 45 includes a cylindrically-shaped elongated spool member 47 that is slidably disposed in a through bore 48 of a valve sleeve or bearing 49. The spool member 47 has a centrally formed indentation 51 in its upper surface and a circumferential groove 52 adjacent its upper end for receiving a snap ring 53 to limit downward axial movement of the spool member 47 in the sleeve 49. Formed about the periphery of the spool member 47 are a plurality of circumferentially spaced axially extended grooves 54 of progressively increasing depth along the lengths thereof.

The valve sleeve member 49 is of a length shorter than the length of the valve spool member 47 and has a peripheral surface formed with longitudinally spaced upper and lower annular recesses 55 and 56, respectively, to define upper and lower land or bearing portions 57 and 58, respectively. The upper bearing portion 57 has an annular groove 59 for an O-ring 60 and, likewise, the bearing portion 58 has a groove 61 for an O-ring 62. The lower land portion 58 engages a shoulder 62*a* (FIG. 4) on the side wall of the chamber means 38 that limits the downward movement of the valve sleeve member 49.

At a position transversely opposite the upper recess 55 the bore 48 of the sleeve member 49 is of an enlarged diameter to form an internal annular groove 64. The common base wall of the recess 55 and groove 64 has a plurality of circumferentially spaced apart apertures 63, and the groove 64 opens to the grooves 54 in the valve spool member 47. O-ring type seals 67 are seated in the valve sleeve 49 and include inner seal members of a rectangular cross section and outer seal members 67*b* of a circular cross section. The inner seal members 67*a* are in contact engagement with the valve spool member 47 to prevent undesired fluid leakage at the end portions of the sleeve 49 for all moved positions of the valve spool member 47.

The spool 47 is normally maintained in a closed position by the high rate coil spring 46, which is in a partially compressed condition and engages the spool 47 through a guide stop 69. The guide stop 69 includes an axially directed nib 72 protruding therefrom for reception in the identation 51 formed in the upper surface of the spool member 47.

As previously mentioned the valve body portion 32 has a passageway 35 open at one end to the port 27 and at its opposite end to the interior chamber means 37 (FIG. 4). The port 24 (FIG. 5) is formed in a side wall 74 of the valve body portion 32 and opens to a passage 75 that extends transversely through the valve body portion 32, but is closed off at the side wall 34 by a threaded plug 76. The passage 75 is constricted at 77, intermediate the side walls 34 and 74, and a check valve 78 is located in the passage 75 between the plug 76 and the constriction 77 to block fluid flow through the passage 75 in a direction toward the side wall 74.

A third port 79 (FIGS. 4 and 5) formed in a side wall 80 of the valve body portion 32 opens to a passage 81 that intersects the passage 75 at the check valve 78. As best shown in FIG. 4, the inner end of the passage 81 is aligned with the recess 55 in the valve sleeve portion 49. The valve assembly 25 is mounted on the side of the cylinder and piston assembly 12 for alignment of the passage 81 with a passage 82 in the end 83 of the assembly 12.

Thus, the passages 81 and 82, the valve sleeve recess 55, and the apertures 63 in the base wall of the recess 55 provide a path of fluid flow from the cylinder end 83 to the valve spool member 47, which in its normal or closed condition blocks such flow path. However, when the valve spool member 47 is moved upward against the high rate spring 46 as a result of the flow of pressurized piloting fluid through the passage 35 and into the lower portion of the chamber 37, fluid flow into the chamber means 37 through the passages 81 and 82 takes place by virtue of the change in position of the flow grooves 54 in the valve spool member 47. Fluid can then flow through certain of the grooves 54 into the upper portion of the chamber means 37 and into a passage 84 (FIG. 4) cut in the body portion 32 to extend from the upper portion of the chamber means 37 to the passage 75 near the sidewall 74. Accordingly, when the valve spool is in one of its variable, actuated "up" positions, a flow path exists from the cylinder blind end 83 through the valve assembly 25 to the fluid line 22.

Referring again to the schematic drawing of FIG. 1, with the control valve member 16 in the neutral position 16*b*, the fluid line 17 is connected directly to the line 21 and no supply fluid is furnished to either of the lines 22 or 23. When the valve member 16 is in the "up" position 16*a*, the line 17 is connected directly to the line 22 for the supply of fluid to the cylinder end 83 through the check valve 78 to move the shaft 11 upward and line 23 is connected to the reservoir via the reservoir return 21. When the valve member 16 is in the "down" position 16*c* the line 17 is connected directly to the line 23 for supplying pressurized piloting fluid to the valve assembly port 27 to move the spool member 47 upward, and the line 22 is connected to the reservoir return line 21 to provide a complete flow path from the cylinder blind end 83 to the reservoir 13, indicated by the solid arrows. In this way, upon actuation of the valve assembly 25, fluid will flow from the cylinder 12 to the reservoir 13 and the cylinder shaft 11 will retract due to the influence of gravity or the load on the shaft 11. Such retraction can be precisely controlled by varying the speed of the pump 15 to increase or decrease the amount of upward movement of the spool member 47 against the action of the spring 46. Consequently the number of flow grooves 54 and the amount of flow groove area that will be opened to fluid flow because of the differing lengths of the grooves 48 can be varied, and the rate of shaft retraction can be precisely increased or decreased corresponding to the particular movement desired.

Control of shaft retraction is not the sole function of the valve assembly 25 because extension of the shaft 11, fluid flow through the valve chamber means 37 is blocked by the valve member 45 as previously described. It should be noted that if the shaft 11 is extended and the control valve 16 is in its neutral position 16*b*, the bleed valve 28 provides a flow path between the lower end of the chamber 37 and the reservoir 13 to insure that the valve assembly 25 is in its normal condition and the check valve 78 is in a locked position serving as a position lock for maintaining the rod 11 in its extended position. Such locking is not dependent upon the integrity of the two external fluid lines connected at ports 24 and 27 integrity for if a line should break, the cylinder 12 will remain locked.

The bleed valve is adjustable to provide a sufficiently high level of hydraulic pressure acting against the spool 47 to fully open the valve 45 when the pump 15 is driven at a maximum set speed for the valve position 16*c* (cylinder shaft retraction). As indicated by the relatively small size of the lower portion of the valve chamber 37, the fluid volume required to move the valve spool 47 from one extreme position to the other is very small. Thus, to obtain optimum control of the fluid pressure and volume delivered to the lower portion of the chamber 37 of the valve assembly 25, most of the fluid must be bypassed through the adjustable bleed valve 28. This permits the variably driven pump 15 to be operated through a speed range that can be easily and precisely controlled and, as an end result, gives precise control of the cylinder shaft's rate of retraction. Through adjustment of the variable bleed valve 28 and the motor driving the pump 15, an infinitely variable pressure against the valve spool 47 can be obtained, which, in turn, offsets the spool 47 against the high rate spring 46 giving truly infinitely controllable retraction of the cylinder shaft.

Figure 8:
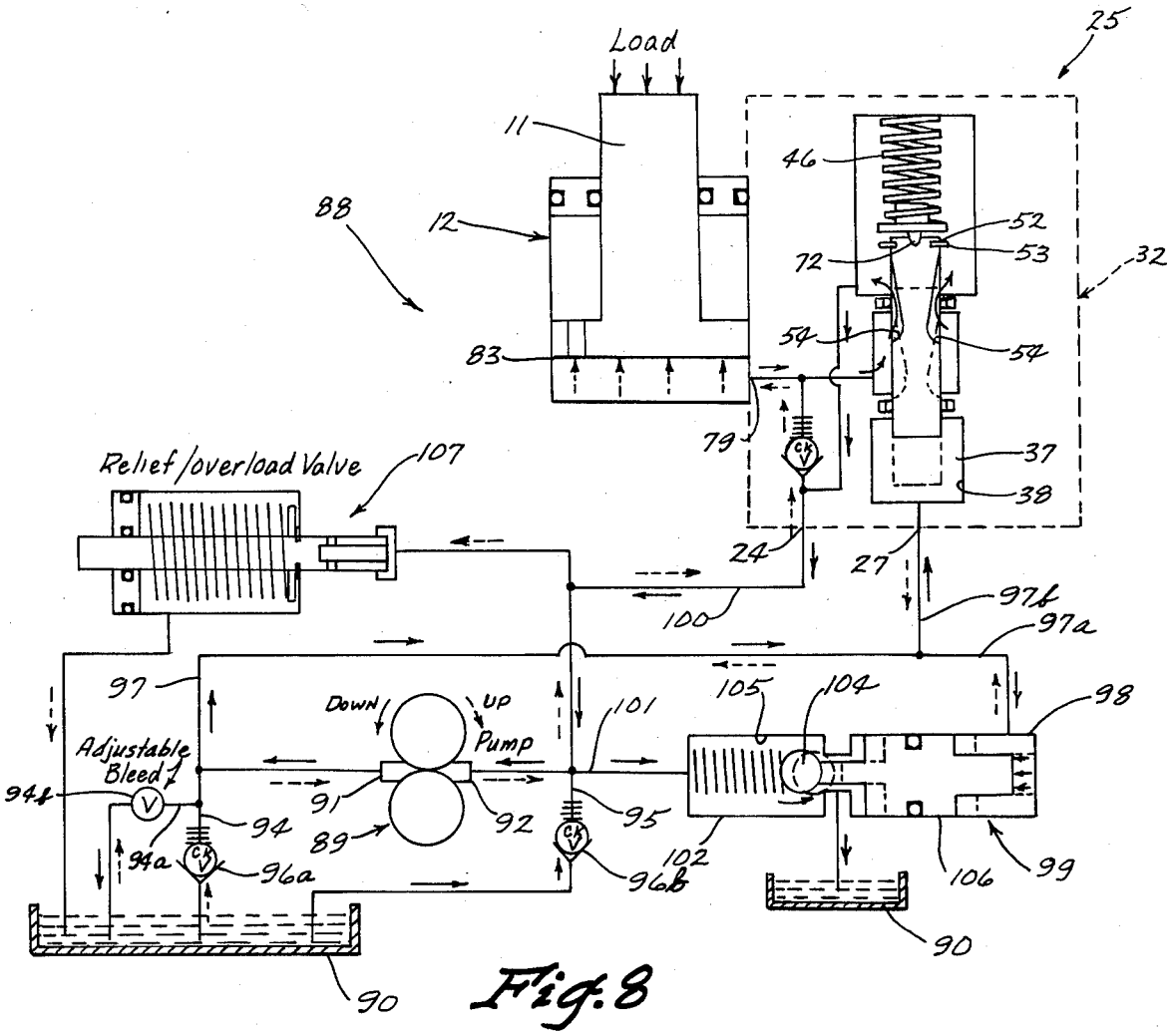
FIG. 8 is a schematic representation of a second preferred embodiment of the control circuit of the present invention.

It is not essential that the control circuit 10 of the present invention include the control valve 16 for, as shown in FIG. 8, a second embodiment of the present invention in the form of a control circuit 88 employs a fixed displacement reversible pump 89 driven by a variable speed reversible electric motor (not shown) instead of the control valve 16. The circuit 88 includes a reservoir 90 that is connected to two ports 91 and 92 of the reversible pump 89 by lines 94 and 95 respectively, having check valves 96*a* and 96*b* blocking return fluid flow from the pump 89 to the reservoir 90. The line 94 is connected with a line 97 having a first branch 97*a* connected to one end 98 of a pilot controlled check valve 99 and a second branch 97*b* connected to the valve assembly port 27. Also, at the downstream side of the check valve 96*a* the line 94 is connected to the reservoir 90 by a line 94*a* and a variable bleed valve 94*b*. The line 95 is joined with both a line 100 connected to the valve assembly port 24 and to a line 101 connected with end 102 of the check valve 99. A spring biased valve or ball 104 is disposed in an interior chamber 105 of the check valve 99 to block flow from the line 101 to the reservoir 90 unless unseated by a piston 106 controlled by the flow of piloting fluid into the valve end 98. Bridged between the line 100 and the reservoir 90 is a pressure relief valve 107 for limiting pressure in the circuit 88 in the extend direction.

When the reversible pump 89 is driven to lower the piston shaft 11, fluid is drawn through the line 95 and the check valve 96*b* from the reservoir 90 along with return fluid through line 100 and is directed via the lines 97 and 97*b* to the port 27 to actuate the valve assembly 25, via lines 97 and 97*a* to the end 98 of the check valve 99 and via the lines 94 and 94*a* through the adjustable bleed valve 94*b*. Accordingly, both the valve assembly 25 and check valve 99 are opened for fluid flow, and fluid from the cylinder blind end 83 is then free to flow through the valve assembly 25, the line 100 and the check valve 99 to return any excess to the reservoir 90, as indicated by the solid arrows in FIG. 8. Of course, such flow is precisely regulated by the amount of actuation of the valve assembly 25 as previously described.

To raise the shaft 11, the pump 89 is reversed so that fluid is drawn from the reservoir 90 by means of the line 94 and the check valve 96*a* and through the adjustable bleed valve 94*b*, and is supplied through the line 100 to the cylinder blind end 83, as indicated by the broken arrows. Thus, the operation of the valve assembly 25 in the circuit 88 is exactly the same as its operation in the circuit 10, and the only difference between the circuits 10 and 88 is the manner in supplying fluid to and receiving fluid from the assembly 25.

Thus, the present invention has been described in connection with two preferred embodiments thereof, but it is to be understood that it is not to be so limited since changes and modifications can be made therein which are within the full intended scope of the invention as defined by the appended claims.

I claim:

1. A control circuit for a hydraulic cylinder and shaft assembly to regulate movement of the shaft relative to one end of the cylinder, comprising:

(a) a variable pressure fluid supply means and a reservoir therefor; and (b) metering valve means having:

(1) a first open passage means connected at one end to said one cylinder end and connectable at an opposite end to said fluid supply means to provide an open path for fluid flow from said supply means to said one cylinder end; and (2) a second normally closed passage means connected at one end to said one cylinder end and connectable at an opposite end to said reservoir, said valve means actuable by a piloting pressure fluid from said variable fluid pressure supply means to adjustably open said normally closed passage means in response to the pressure of the fluid from said supply means; and (c) said fluid supply means, in a first condition thereof, supplying fluid under a pressure through said first passage means to said one cylinder end to move said shaft from said one cylinder end, and in a second condition thereof, supplying pilot fluid under variable pressure to said metering valve means, to actuate said valve means and regulate fluid flow from said one cylinder end to said reservoir through said normally closed passage means to provide a precisely controlled movement of said shaft toward said one cylinder end.

2. A control circuit according to claim 1 wherein said circuit further comprises a fluid pressure regulating means associated with said metering valve means to adjustably regulate the pressure of the fluid supplied to said valve means.

3. A control circuit according to claim 2, wherein said metering valve means further comprises:

(a) a valve housing having:

(1) an interior valve chamber;

(2) a first passage connected at one end to one end of the chamber and connected at an opposite end to said supply means when said supply means is in said second condition;

(3) a second passage connected at one end to an opposite end of the chamber; and (4) a third passage connected at one end to the chamber at a point intermediate the ends of the chamber;

(5) one of said second and third passages having an opposite end connected with said one cylinder end and the other of said passages having an opposite end connectable with said reservoir, when said supply means is in said second condition;

(b) a valve member positioned in said chamber to block fluid flow between said second and third passages in a closed condition whereby said second and third passages serve as said normally closed passage means and having:

(1) a valve sleeve;

(2) a valve spool slidably disposed in said sleeve and axially movable therein in response to piloting fluid flow through said first passage into said one end of said chamber to regulate flow between said second and third passages;

(c) a bias member positioned in said chamber for normally maintaining said valve member in a closed condition until said piloting fluid enters said one end of the chamber.

4. A control circuit according to claim 3 wherein said valve sleeve and valve spool have:

(a) coacting passage means constructed such that when said valve member is actuated, certain of said passage means extend between said second and third passages in correspondence to the pressure level of the piloting fluid supplied to said valve means.

5. A control circuit for a hydraulic cylinder and shaft assembly to regulate movement of the shaft relative to one end of the cylinder, comprising:

(a) a fluid reservoir;

(b) a variable speed fluid pump connected to said reservoir;

(c) metering valve means having:

(1) a first open passage means connected at one end to said one cylinder end and connectable at an opposite end to said fluid reservoir to provide an open path for fluid flow from said reservoir to said one cylinder end; and (2) a second normally closed passage means interconnected with said one cylinder end and said fluid reservoir, and said valve means actuable by a piloting pressure fluid from said variable speed pump to adjustably open said normally closed passage means in response to the fluid pressure from said variable speed pump;

(d) directional control valve means, in a first position thereof, connecting said fluid pump to said opposite end of said first open passage means to supply fluid under pressure thereto for movement of the shaft from said one cylinder end and, in a second position thereof, connecting said fluid pump to said valve means to supply piloting fluid under variable pressure thereto to actuate said metering valve means and regulate fluid flow from said one cylinder end to said reservoir through said normally closed passage means to provide a precisely controlled movement of the shaft toward said one cylinder end.

6. A control circuit according to claim 5, wherein said circuit further comprises a fluid pressure regulating means associated with said metering valve means to adjustably regulate the pressure of the fluid supplied to said valve means.

7. A control circuit according to claim 5, wherein said metering valve means further comprises:

(a) a valve housing having:

(1) an interior valve chamber;

(2) a first passage connected at one end to one end of the chamber and connected at an opposite end to said supply means when said supply means is in said second condition;

(3) a second passage connected at one end to an opposite end of the chamber; and (4) a third passage intermediate the ends of the chamber at a point intermediate the ends of the chamber;

(5) one of said second and third passages having an opposite end connected with said one cylinder end and the other of said passages having an opposite end connectable with said reservoir, when said supply means is in said second condition;

(b) a valve member positioned in said chamber to block fluid flow between said second and third passages in a closed condition whereby said second and third passages serve as said normally closed passage means and having:

(1) a valve sleeve;

(2) a valve spool slidably disposed in said sleeve and axially movable therein in response to piloting fluid flow through said first passage into said one end of said chamber to regulate flow between said second and third passages;

(c) a bias member positioned in said chamber for normally maintaining said valve member in a closed condition until said piloting fluid enters said one end of the chamber.

8. A control circuit according to claim 7, wherein said valve sleeve and valve spool have:

(a) coacting passage means constructed such that when said valve member is actuated, certain of said passage means extend between said second and third passages in correspondence to the pressure level of the piloting fluid supplied to said valve means.

9. A control circuit for a hydraulic cylinder and shaft assembly to regulate movement of the shaft relative to one end of the cylinder, comprising:

(a) a fluid reservoir;

(b) a first metering valve means having a normally closed passage means connected at one end to said one cylinder end and having an opposite end connectable to said reservoir and said valve means being actuated by piloting fluid to open said normally closed passage means;

(c) a second metering valve means having a normally closed flow passage that is opened upon actuation of said valve means by piloting fluid, and is connected at one end to said normally closed passage means and has an opposite end connected to said reservoir;

(d) a fixed displacement, reversible fluid pump, when driven at a variable speed in one direction, to provide fluid under pressure through a check valve to said one cylinder end to move said shaft from said one cylinder end and, when driven in a reverse direction, to provide piloting fluid to said first and second valve means to actuate said valve means and regulate fluid flow from said one cylinder end to said reservoir to permit movement of said shaft toward said one cylinder end.

10. A control circuit according to claim 9 wherein said circuit further comprises a fluid pressure regulating means associated with said first metering valve means to adjustably regulate the pressure of the fluid supplied to said first valve means.

11. A control circuit according to claim 9, wherein:

(a) said first metering valve means further comprises an open passage means connected at one end to said one cylinder end and having an opposite end connected to said fluid pump when said pump is driven at variable speed in said one direction so that said fluid under pressure is supplied to said one cylinder end through said open passage means.

12. A control circuit according to claim 9, wherein said first metering valve means further comprises:

(a) a valve housing having:

(1) an interior valve chamber;

(2) a first passage connected at one end to one end of the chamber and connected at an opposite end to said fluid pump when said pump is driven in said one direction;

(3) a second passage connected at one end to an opposite end of the chamber; and (4) a third passage connected at one end to the chamber at a point intermediate the ends of the chamber;

(5) one of said second and third passages having an opposite end connected with said one cylinder end and the other of said passages having an opposite end connectable with said reservoir, when said pump is driven in said reverse direction;

(b) a valve member positioned in said chamber to block fluid flow between said second and third passages in a normal condition whereby said second and third passages serve as said normally closed passage means and having:

(1) a valve sleeve;

(2) a valve spool slidably disposed in said sleeve and axially movable therein in response to piloting fluid flow through said first passage into said one end of said chamber to regulate flow between said second and third passages;

(c) a bias member positioned in said chamber for normally maintaining said valve member in a closed condition until said piloting fluid enters said one end of said chamber.

13. A control circuit according to claim 12, wherein said valve sleeve and valve spool have:

(a) coacting passage means constructed such that when said valve member is actuated, certain of said passage means extend between said second and third passages in correspondence to the pressure level of the piloting fluid supplied to said valve means.

* * * * *